US008684868B2

(12) United States Patent
Fountain, III

(10) Patent No.: US 8,684,868 B2
(45) Date of Patent: Apr. 1, 2014

(54) BALL FOR USE IN TEACHING PITCHING SKILLS

(75) Inventor: Kenneth Richard Fountain, III, Kirksville, MO (US)

(73) Assignee: Velocity Gravity Spin Innovations LLC, Kirksville, MO (US)

( * ) Notice: Subject to any disclaimer, the term of this patent is extended or adjusted under 35 U.S.C. 154(b) by 147 days.

(21) Appl. No.: 13/192,800

(22) Filed: Jul. 28, 2011

(65) Prior Publication Data

US 2012/0149501 A1 Jun. 14, 2012

Related U.S. Application Data

(60) Provisional application No. 61/426,454, filed on Dec. 22, 2010, provisional application No. 61/422,247, filed on Dec. 13, 2010.

(51) Int. Cl.
*A63B 41/00* (2006.01)

(52) U.S. Cl.
USPC ..... 473/571; 473/594

(58) Field of Classification Search
USPC ..... 473/457, 570, 571, 594
See application file for complete search history.

(56) References Cited

U.S. PATENT DOCUMENTS

| | | | | |
|---|---|---|---|---|
| 2,709,595 | A * | 5/1955 | De Vries | 473/200 |
| 4,943,055 | A | 7/1990 | Corley | |
| 6,645,083 | B1 | 11/2003 | Armstrong, III et al. | |
| 6,651,497 | B2 | 11/2003 | Imatoh | |
| 6,991,561 | B2 * | 1/2006 | Nesbitt et al. | 473/355 |
| 7,008,351 | B2 * | 3/2006 | Parker | 482/44 |
| 7,338,395 | B1 | 3/2008 | Hurley | |
| 7,753,811 | B2 | 7/2010 | Mark | |

OTHER PUBLICATIONS

Ernie Parker Products, Inc., Training Tools, Improving Your Pitching Skills, http://www.ernieparkerproducts.com/12.html, two pages, dated May 24, 2011.

* cited by examiner

*Primary Examiner* — Vishu K. Mendiratta
(74) *Attorney, Agent, or Firm* — Shook, Hardy & Bacon L.L.P.

(57) ABSTRACT

A ball for use in teaching proper throwing or pitching techniques in baseball or softball is disclosed. The ball provides an internal mechanism by way of a snap device or a channel having a shiftable weighted material to provide both an audible and visible indication of when a proper wrist snap release of the ball has occurred. The internal mechanisms disclosed can be incorporated into newly manufactured baseballs or softballs or placed into preexisting balls.

4 Claims, 4 Drawing Sheets

BALL FOR USE IN TEACHING PITCHING SKILLS

CROSS-REFERENCE TO RELATED APPLICATIONS

This application claims priority to U.S. Provisional Patent Application Ser. No. 61/422,247 entitled A Modified Ball for Teaching Pitching Spin Skills and U.S. Provisional Patent Application Ser. No. 61/426,454 entitled A Clicker Ball for Training Pitching and Throwing in Softball and Baseball.

TECHNICAL FIELD

The present invention generally relates to pitching and throwing of game balls such as baseballs and softballs. More specifically, the present invention pertains to a training ball used by baseball and softball players for learning a proper throwing technique.

BACKGROUND OF THE INVENTION

A critical element to the development of any young baseball or softball player is for the player to learn how to the properly release the ball. This is especially critical for a pitcher. More specifically, it is necessary for the players to develop a proper snap of their wrist when releasing the ball, whether for pitching, throwing to a base, or throwing from the outfield to the infield. Many hours of individual attention teaching the proper wrist snap is often necessary, especially for teaching a proper pitching technique in girls fast-pitch softball. Failure to properly snap the wrist when releasing the ball will result in improper travel of the ball and reduced accuracy.

A standard softball or baseball comprises a plastic core or tightly bound fiber having a cover. For baseball, the ball typically weighs approximately 5 oz. and has a circumference of approximately 9 inches. A standard softball however can vary in size and weight depending on the type of play—fastpitch or slowpitch.

Having a proper snap release is necessary for success regardless of playing position. For a pitcher, releasing the ball with the proper snap will determine the velocity and power of the thrown ball as well as help to provide the necessary movement for throwing pitches such as a "fastball" and "drop ball." Furthermore, a proper snap release aids the timing of the wrist snap for other pitches such as "riseball", "curveball", and a "screwball." Learning these types of pitches is desirable, especially in fast pitch softball, because of the adverse affect a moving pitch has on the timing of a batter's swing. A proper snap is imparted by a combination of wrist, finger, and forearm muscles. For a position player, throwing the ball overhand is basically the same motion as throwing a fastball pitch overhand.

Therefore, in order to improve a player's baseball or softball skills, it is desirable to provide a way of teaching a player how to properly release a baseball or softball.

SUMMARY

Embodiments of the present invention are directed generally towards a pitching device designed to train a player on a proper throwing or pitching technique.

In one embodiment of the present invention, a ball for use in teaching proper release for pitching or throwing is disclosed in which the ball has a core with a passageway extending through a portion of the core. A magnetic device is located at an end of the passageway within the core of the ball and a cap fixed at an opposing end with a metallic component positioned within the passageway. The metallic component is capable of sliding between the magnetic device and the cap such that when a user properly releases the ball, the thrower or pitcher receives an audible indication of the metallic component sliding from the magnetic device and contacting the cap.

In an alternate embodiment of the present invention, a ball provides an audible and visual indication of the flight path where the ball core includes a generally vertically-oriented passageway positioned along an axis of the ball core with a generally horizontally-oriented passageway intersecting the generally vertically-oriented passageway. Located within the generally vertically-oriented passageway is a shiftable weighted material such that based on the motion of the ball, the shiftable weighted material can pass between the generally vertically-oriented passageway and the generally horizontally-oriented passageway.

In yet another embodiment of the present invention, a ball for use in teaching a proper release for pitching and throwing is provided where the ball comprises a snap device having a magnetic device, a cap, and a metallic component located in the passageway. The ball also comprises a generally vertically-oriented passageway intersecting with a generally horizontally-oriented passageway and a plurality of shiftable weighted material located within the generally vertically-oriented passageway. The shiftable weighted material can pass between the generally-vertically oriented passageway and the generally horizontally-oriented passageway.

Additional advantages and features of the present invention will be set forth in part in a description which follows, and in part will become apparent to those skilled in the art upon examination of the following, or may be learned from practice of the invention.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventor has contemplated that the claimed subject matter might also be embodied in other ways, to include different components, combinations of components, steps, or combinations of steps similar to the ones described in this document, in conjunction with other present or future technologies.

Figure 1:
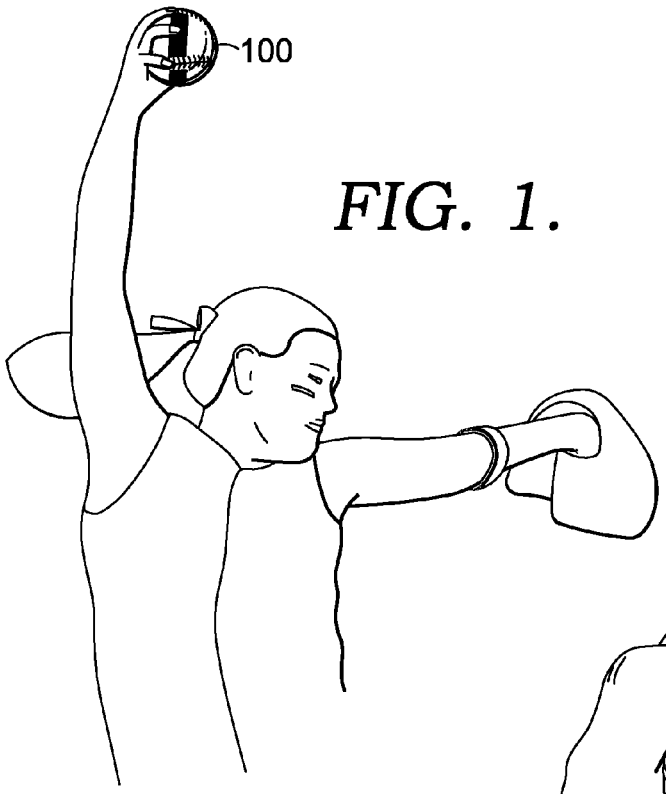
FIG. 1 depicts a view of a pitcher utilizing an embodiment of the present invention.
Figure 2:
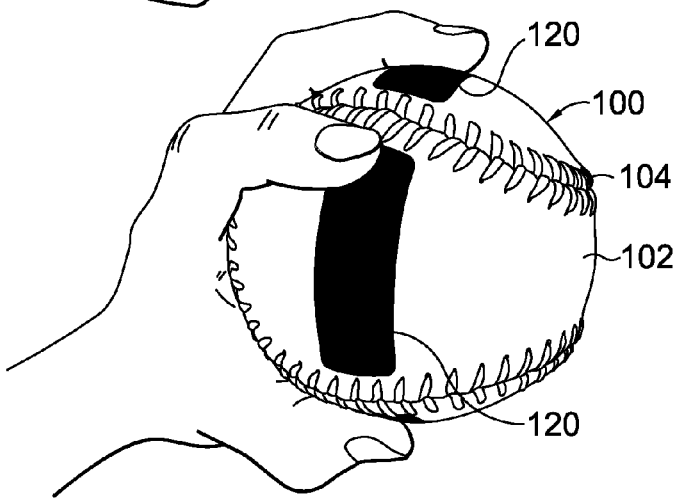
FIG. 2 depicts a detailed view of a portion of FIG. 1 indicating a way of gripping an embodiment of the present invention.
Figure 3:
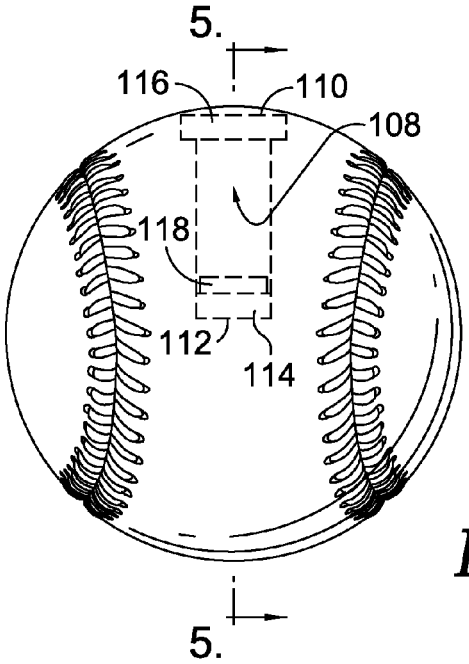
FIG. 3 depicts a softball in accordance with an embodiment of the present invention.
Figure 4:
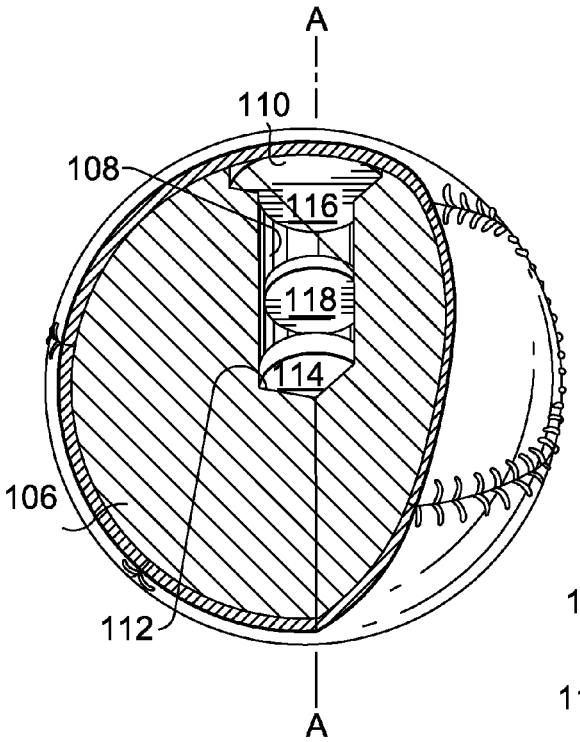
FIG. 4 depicts a cut-away view of a softball in accordance with an embodiment of the present invention.
Figure 5:
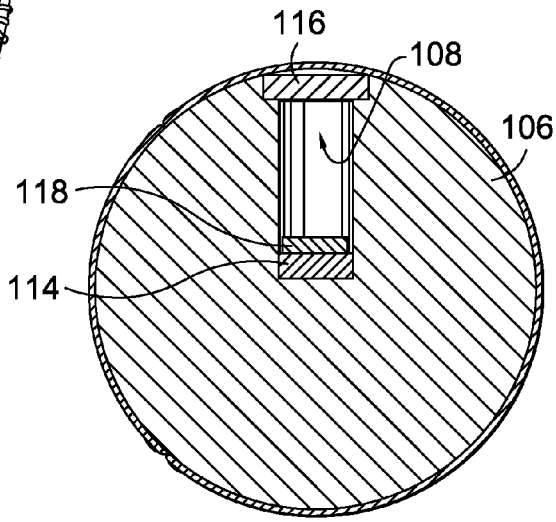
FIG. 5 depicts a cross section of the softball of FIG. 3 in accordance with an embodiment of the present invention.
Figure 6:
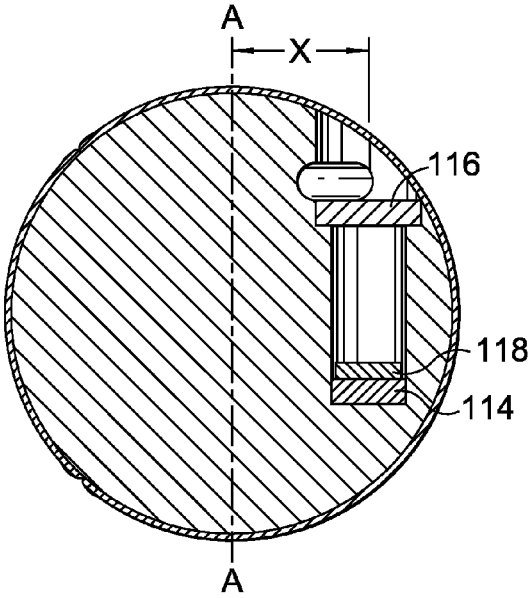
FIG. 6 depicts a cross-section view of a softball in accordance with an alternate embodiment of the present invention.

Referring initially to FIGS. 1 and 2, a user, such as a pitcher or fielder is shown preparing to throw the ball 100. The ball 100 includes the traditional external construction of a leather sheathing or covering 102 stitched together along seams 104. Referring to FIGS. 3-5, an embodiment of the present invention, also known as a snap configuration, provides a ball 100 for use in teaching a proper release for pitching or throwing the ball comprising a ball core 106 having a passageway 108 extending through a portion of the ball core 106, and located along a center axis of the ball 100. In an alternate embodiment of the present invention, it is possible for the passageway to be located off the center axis, as shown in FIG. 6. The passageway 108 has a first end 110 adjacent an outer surface 102 of the ball core 106 and extends to a second end 112 located within the ball core 106. While the passageway is formed by removing material of the ball core 106, in an embodiment of the invention it is possible to have the passageway 108 lined with a plastic coating or tubing.

The ball 100 also includes a magnetic device 114 located adjacent the second end 112 of the passageway 108 with the magnetic device 114 being secured within the passageway 108. The magnetic device 114 is secured to the second end 112 of the passageway 108 by a fastener, glue, screw or other common securing mechanism. Fixed adjacent the first end 110 is a cap 116 that is positioned to close off the passageway 108. In an embodiment of the present invention, the cap 116 can be an acrylic plate. Located within the passageway 108 is a metallic component 118 that is capable of sliding between the magnetic device 114 and the cap 116.

In use, when a pitcher or thrower releases the ball 100 with the proper wrist snap, the metallic component 118, which is initially attracted to the magnetic device 114, will decouple, slide down the passageway 108, and contact the cap 116, creating an audible indication, such as a clicking sound, thereby confirming a proper throwing position was achieved.

In an embodiment of the invention, the metallic component 118 can be a washer, nut or ball bearing. Through development of the present invention, it has been determined that when there is too much surface area contact between the metallic component 118 and the magnetic device 114, it is possible that the metallic component 118 will have too much attraction to the magnetic device 114, and therefore not be consistently able to separate from the magnetic device 114 upon a proper wrist snap. A more favorable design utilizes a nut or ball bearing, because the nut or ball bearing provides a smaller contact surface area between the metallic component 118 and the magnetic device 114. The smaller contact surface area provides a sufficient amount of contact with the magnetic device 114 but not too large of a contact area that would prevent the metallic component 118 from separating from the magnetic device 114 upon a proper release of the ball. Using a washer as the metallic component 118 was found to provide too much surface area, especially if it landed flat on the magnetic device 114. Further, if the washer landed sideways on the magnetic device 114, it would be too easy to snap off of the magnetic device. A ball bearing provides an additional benefit to beginning throwers who have a very weak wrist snap, due to the reduced contact surface area, while a nut works better for average throwers because of the slightly larger surface area.

Figure 7:
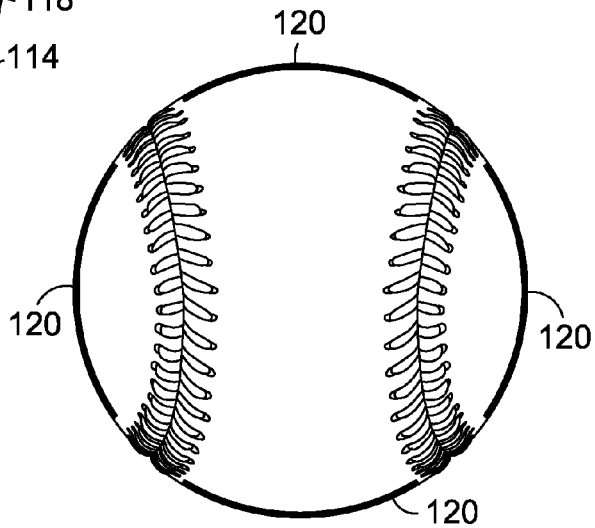
FIG. 7 depicts a top elevation view of a softball in accordance with an embodiment of the present invention.
Figure 8:
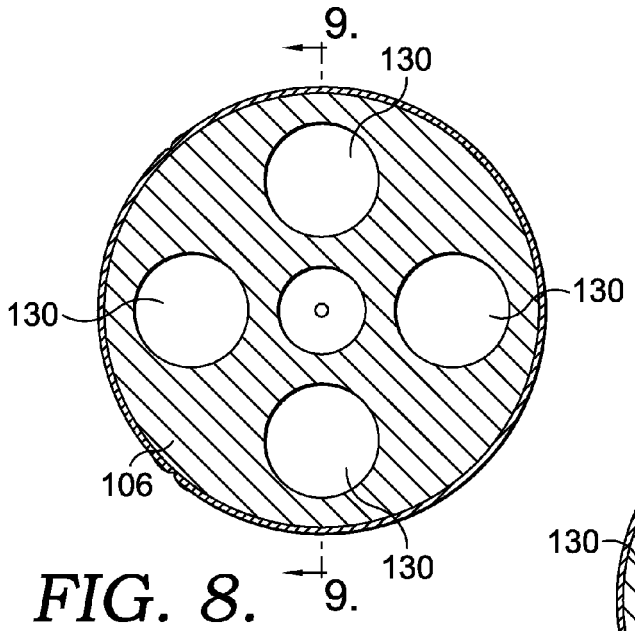
FIG. 8 depicts a cross-section view of a softball in accordance with another alternate embodiment of the present invention.
Figure 9:
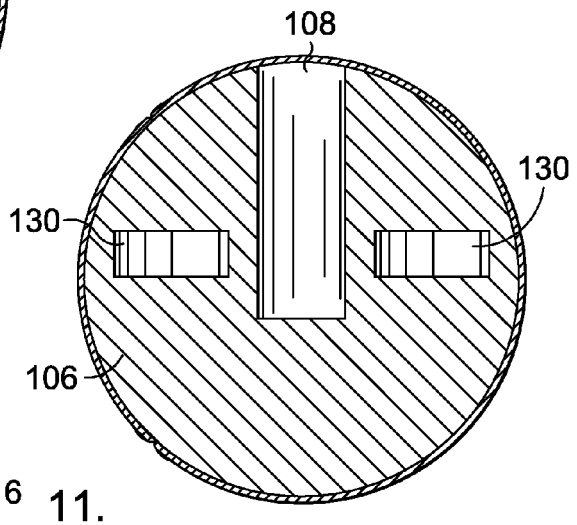
FIG. 9 depicts a cross section view taken through the softball of FIG. 8 in accordance with another alternate embodiment of the present invention.

In an alternate embodiment of the invention depicted in FIGS. 8 and 9, additional weight slots 130 are used to incorporate stationary weights within the ball 100, which provides a way of increasing the weight of the ball so as to strengthen players who use the ball by creating a heavier than normal ball for training. Adding weight to the ball configuration discussed above and shown in FIGS. 1-7 forces the pitcher to release the ball at the optimum point with more force so as to obtain the proper snapping technique. This builds a pitcher's muscle strength and results in a stronger snap, greater velocity, and greater accuracy than with a typical baseball or softball. Improving the throwing technique through an increased weighted ball will improve pitching and fielding accuracy as well as the quality of the game. If weight is added properly to the ball (i.e. evenly distributed as shown in FIGS. 8 and 9), then usually no counterweight is necessary. However, if additional weight is improperly added through weight slots 130 for the ball configuration described above and as applied to the ball shown in FIGS. 1-7 for a spin ball, then it is necessary to add counterweight to the ball.

Referring to FIGS. 8 and 9, in order to increase the weight of the ball 100, typically, four such weight slots 130 are placed in the ball core 106, as close to the center of the ball core 106 as possible. To determine the amount of weight to be added in the weight slots 130, the ball core 106, hardware, and leather covering 102 are weighed and then subtracted from a target weight. The amount of weight to be added, which is most easily accomplished by bird shot, is then equally divided into the four weight slots 130 for the ball 100.

The pitcher can also receive a visual indication confirming the proper release of the ball through a series of stripes or markings 120, as shown in FIGS. 2 and 7. When the ball is released in the proper position, the stripes 120 will rotate so as to create the appearance of a continuous rotating stripe.

While the ball configuration having the passageway 108, magnetic device 114, metallic components 118, and cap 116 are depicted along a central axis of the ball, in an alternate embodiment of the present invention, these same components can be offset by a distance X, as shown in FIG. 6. By offsetting these components from the center axis of the ball the pitcher or thrower can be taught to impart a spin on the training ball, causing it to move in a desired fashion when thrown.

Figure 10:
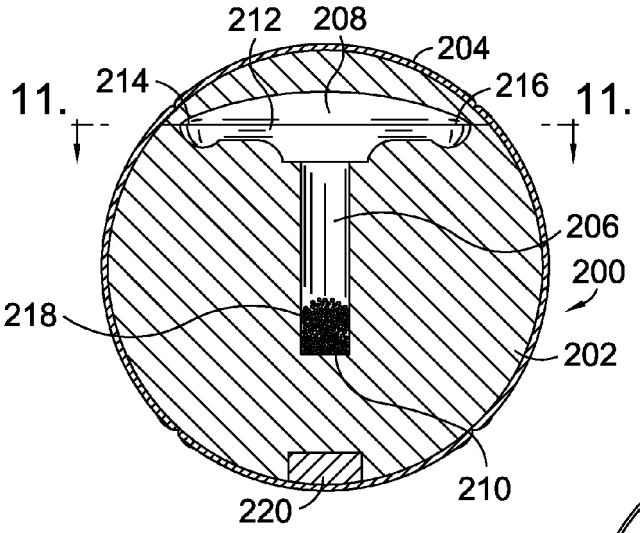
FIG. 10 depicts a cross section view of a softball in accordance with yet another alternate embodiment of the present invention.
Figure 11:
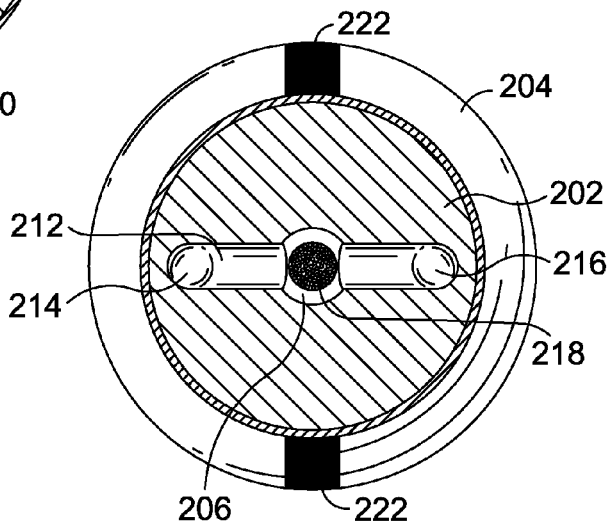
FIG. 11 depicts a top section view of the softball of FIG. 10 in accordance with yet another embodiment of the present invention.
Figure 12:
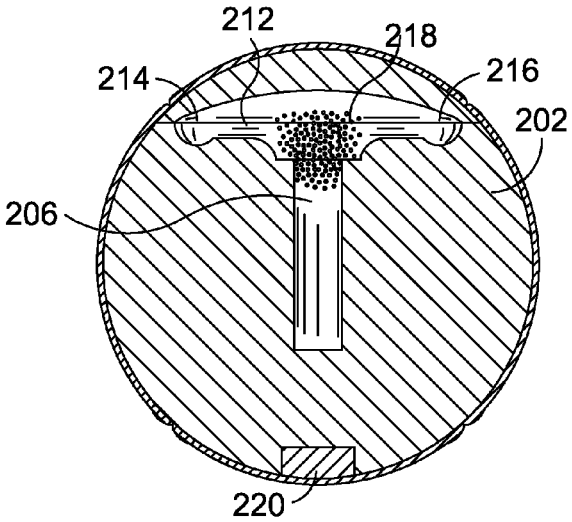
FIG. 12 depicts the cross section view of the softball of FIG. 10 in which the shiftable weighted material is repositioning within the passageways in accordance with yet another alternate embodiment of the present invention.
Figure 13:
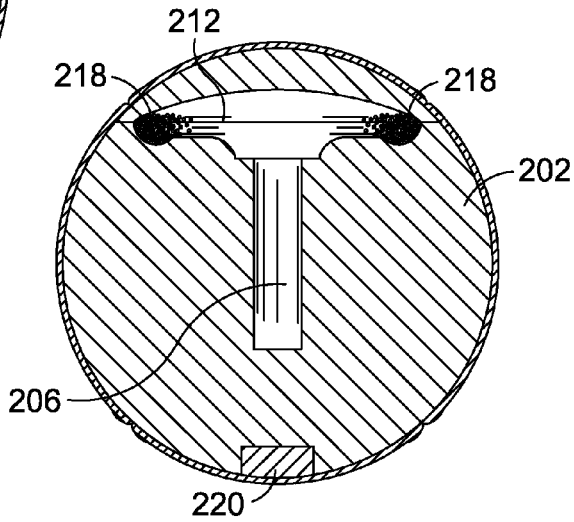
FIG. 13 depicts another cross section view of the softball of FIG. 10 in which the shiftable weighted material is repositioning within the passageways in accordance with yet another alternate embodiment of the present invention.

An alternate embodiment of the present invention is depicted in FIGS. 10-13. In this alternate embodiment, a ball 200 for use in teaching a proper release position by providing an audible indication of an improper release as well as a visual indication by way of a flightpath. The ball 200 comprises a ball core 202 having an outer covering 204 and a generally vertically-oriented passageway 206 positioned along an axis of the ball core 202, such as a center axis, and having a first end 208 and a extending through a portion of the ball core 202 to a second end 210. A generally horizontally-extending passageway 212 having an opposing first end region 214 and second end region 216 intersects the generally vertically-oriented passageway 206 proximate the first end 208. The passageways 206 and 212 thereby form a general "T-shape" configuration. The first end region 214 and second end region 216 have a depth that extends deeper into the ball core 202 greater than a depth of the generally horizontally-oriented passageway 212, as depicted in FIGS. 10, 12, and 13.

Located initially within the generally vertically-oriented passageway 206 is a shiftable weighted material 218, such as bird shot, lead pellets, glass beads, sand, or gravel, each having a density preferably greater than the ball core 202. This shiftable weighted material 218 can pass between the generally vertically-oriented passageway 206 and the generally horizontally-oriented passageway 212, depending on the motion of the ball 200. That is, if upon release of the ball 200 by a thrower or pitcher, the ball 200 is not released with the proper wrist snap, at least a portion of the shiftable weighted material 218, will travel from the generally vertically-oriented passageway 206 to the first and second end regions 214 and 216 of the generally horizontally-oriented passageway 212, as shown in FIGS. 10, 12, and 13. Note that the generally horizontally-oriented passageway may also include taper between the generally vertically-oriented passageway 206 and the end regions 214 and 216. The slight taper or arc to the generally horizontally-oriented passageway 212 helps to keep the shot towards the center of the axis on which the ball is spinning.

It is also desirable for this embodiment of the invention to include a counterweight 220 positioned along the axis of the generally vertically-oriented passageway 206. Because of the ball core material removed, as well as the weighted ball material added, and its ability to shift depending on the release point, it is necessary to provide a counter weight in the ball 200. A counterweight pocket can be added to the ball core 202 by placing the ball on a flat surface, such as a press plate, and along the same axis as the generally vertically oriented passageway 206, drilling a hole approximately ½" in diameter with a drill press or other equivalent material removal technique. As with the generally vertically-oriented passageway 206, the depth of the counter weight pocket will depend on the amount of counterweight to be placed within the ball core 202. Once the passageways and counterweight pockets are located in the ball core 202, the weighted ball material and counterweight material 220 is placed in the respective openings. Since different ball manufacturers use different weighted cores, one way to determine the proper amount of counterweight 220, is to weigh the ball cover, thread, and ball core. Then, this weight is subtracted from the desired target weight of the finished ball. The difference is then divided into a 2:1 ratio with the one part equaling the counterweight 220 and two parts being incorporated into the components forming the weight chamber (i.e. lead shot or other shiftable weighted material 218).

The pitcher or thrower of the ball 200 can also receive a visual indication confirming the proper release of the ball 200 through a series of stripes or markings 222, as shown in FIG. 11, as well as watching the trajectory and flight path of the ball. When the ball is released in the proper snap, the ball 200 will rotate such that the intermittent markings 222 will have the appearance of a continuous stripe.

The ball 200 also provides an audible indication of whether the ball was properly or improperly released. When a proper release occurs, the shiftable weighted material 218 will remain in the generally vertically-oriented passageway 206 such that a swoosh sound or loud, sharp rattle is heard by movement of the shiftable weighted material 218. However, when the ball 200 is not released with the proper wrist snap, thereby causing the ball to rotate off-axis from the generally vertically-oriented passageway 206, the shiftable weighted material 218 passes to the first and second passage ends 214 and 216 causing a rattling sound and causing the ball to wobble in flight, indicating an improper release. Furthermore, if the weight shifts to the passage ends 214 and 216 in an unbalanced fashion, it also causes an unbalanced feel to the ball giving a physical feedback to the thrower just before release, indicating an improper release angle. Use of the ball 200 disclosed in FIGS. 10-13 is useful in teaching specific types of pitches including a "riseball", "screwball", "dropball", and "curveball."

Figure 14:
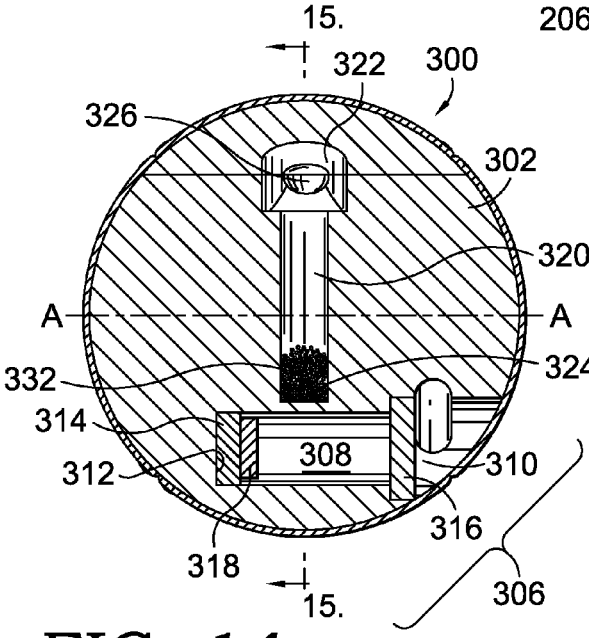
FIG. 14 depicts a cross section view of a softball in accordance with yet another alternate embodiment of the present invention; and, FIG. 15 depicts a cross section taken through FIG. 14 in accordance with yet another alternate embodiment of the present invention.
Figure 15:
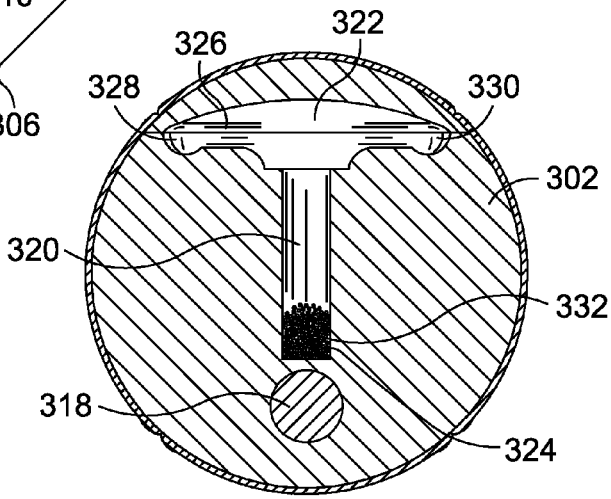

In yet another embodiment of the present invention, the weighting techniques of the previously-discussed configurations can be combined within a single ball, as depicted by FIGS. 14 and 15. The ball 300 comprises a ball core 302 having an outer covering 304 and a snap device 306 comprising a passageway 308 located a distance from a center axis A-A and having a first end 310 adjacent the outer surface of the ball core 302 and a second end 312 spaced a distance from the first end 310 and located within the ball core 302. Located adjacent the second end 312 and secured within the passageway 308 is a magnetic device 314. Positioned opposite the magnetic device 314 and adjacent the first end 310 is a cap 316 for enclosing the passageway 308. Contained within the passageway 308, and as previously discussed with respect to FIGS. 1-7, is a metallic component 318, such that the metallic component 318 is capable of sliding between the magnetic device 314 and the cap 316. The metallic component 318 is generally attracted to the magnetic device 314, yet can decouple from the magnetic device 314 upon a proper wrist snap during release of the ball by a pitcher or thrower.

The ball 300 further comprises a generally vertically-oriented passageway 320 positioned perpendicular to the center axis A-A and the passageway 308 of the snap device 306. The generally vertically-oriented passageway 320 has a first end 322 and extends through the ball core 302 to a second end 324. The generally vertically-oriented passageway 320 intersects with a generally horizontally-oriented passageway 326 proximate the first end 322 and includes opposing first and second end regions, 328 and 330, respectively. As previously discussed above, the first and second end regions 328 and 330 have a depth that extends deeper into the ball core 302 than a depth of the generally horizontally-oriented passageway 326.

Located initially within the generally vertically-oriented passageway 320 is a plurality of shiftable weighted material 332 such as bird shot, lead pellets, glass beads, sand, gravel or other similar type material. In operation, when a pitcher or thrower releases the ball, the shiftable weighted material 332 can pass between the generally vertically-oriented passageway 320 and the generally horizontally-oriented passageway 326. This shifting of the weighted material 332 will provide an audible indication, in the form of a rattling sound, in the event the ball 300 is not properly released. Furthermore, the ball 300 provides a visible indication of improper release in the form of a wobble to the flight path due to the non-uniform weight distribution caused by the weighted material 332 passing to the first and second end regions 328 and 330. However, if the ball is released with the proper wrist snap the metallic component 318 slides through the passageway 308, from the magnetic device 314 to the cap 316, thereby providing an audible clicking sound indicating a proper release.

This configuration of the ball 300 combining both a snap device as well as the shiftable weighted material is useful in teaching various types of pitches including a "riseball", "dropball", "screwball", and "curveball."

The present invention can be incorporated into a newly manufactured baseball or softball (prior to the leather covering being applied) or into an existing baseball or softball. For example, where an embodiment of the invention depicted in FIGS. 10-13 is incorporated into an existing softball, the leather covering is removed and a portion of the ball is cut and removed, forming a cap portion. Next, the generally vertically-oriented passageway is cut into the ball core as well as the generally horizontally-extending passageway, so as to form a general "T-shape." The depth of the generally vertically-oriented passageway will depend on the amount of weighted ball material to be placed within the passageway. The heavier the ball, the more weighted ball material necessary, and hence, the deeper the generally vertically-oriented passageway. Depending on the manufacturing technique used, it may be necessary to file down any sharp corners so as to allow for easy movement of the weighted ball material between the generally vertically-oriented passageway and the generally horizontally-oriented passageway. The filing or rounding process will also help form the first and second end regions of the generally horizontally-oriented passageway in which weighted ball material will be able to collect. A relief cut is also placed within the cap portion of the ball previously removed, so as to help form the generally horizontally-oriented passageway when the end of the ball is reattached to the ball core.

As previously discussed, it may also be necessary to incorporate a counterweight pocket into the ball core along the axis of the generally vertically-oriented passageway. The amount of weight and counterweight is determined and then placed within the counter weight pocket. A cap is then secured over the counterweight pocket, such as by glue or other acceptable securing mechanism. Then, the generally vertically-oriented passageway is filled with the corresponding amount of weighted ball material, and the cap portion of the of the ball is secured to the ball core by glue or other acceptable securing mechanism. Finally, the leather covering is then stitched around the ball core.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A ball for use in teaching a proper release for pitching or throwing comprising:

a ball core having an outer covering attached thereto;

a snap device comprising:

a passageway located a distance from a center axis of the ball core having a first end adjacent an outer surface of the ball core and a second end spaced a distance form the first end and located with the ball core;

a magnetic device located adjacent the second end of the passageway and secured within the passageway; and, a cap fixed adjacent to the first end of the passageway; and a metallic component positioned within the passageway and capable of sliding between the magnetic device and the cap;

a generally vertically-oriented passageway positioned perpendicular to the center axis and having a first end and extending through a portion of the ball core to a second end;

a generally horizontally-oriented passageway having opposing first and second end regions, the horizontally-oriented passageway intersecting the generally vertically-oriented passageway proximate the first end; and, a plurality of shiftable weighted material located within the generally vertically-oriented passageway;

wherein when a user releases the ball in a throwing motion, the shiftable weighted material passes between the generally vertically-oriented passageway and the generally horizontally-oriented passageway providing an audible noise indicating an improper release or the metallic component slides from the magnetic device and contacts the cap thereby providing an alternate noise indicating a proper release.

2. The ball of claim 1, wherein the opposing first and second end regions of the generally horizontally-oriented passageway have a depth extending into the ball core greater than a depth of the generally horizontally-oriented passageway.

3. The ball of claim 1, wherein the shiftable weighted material is selected from the group comprising: bird shot, lead pellets, glass beads, sand, or gravel.

4. The ball of claim 1, wherein the metallic component is attracted to the magnetic device yet can decouple from the magnetic device when a user properly throws or pitches the ball.

* * * * *